US009090074B2

(12) United States Patent
Muraki et al.

(10) Patent No.: US 9,090,074 B2
(45) Date of Patent: Jul. 28, 2015

(54) INK-JET RECORDING APPARATUS

(75) Inventors: Motohito Muraki, Nagoya (JP); Takashi Ohama, Iwakura (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/434,493

(22) Filed: Mar. 29, 2012

(65) Prior Publication Data

US 2013/0063531 A1 Mar. 14, 2013

(30) Foreign Application Priority Data

Sep. 9, 2011 (JP) ..... 2011-197160

(51) Int. Cl.
*B41J 29/20* (2006.01)
*B41J 2/175* (2006.01)
*B41J 19/20* (2006.01)

(52) U.S. Cl.
CPC . *B41J 2/175* (2013.01); *B41J 19/20* (2013.01)

(58) Field of Classification Search
USPC ..... 347/84–86, 102–108
See application file for complete search history.

(56) References Cited

U.S. PATENT DOCUMENTS

| | | | | |
|---|---|---|---|---|
| 4,580,150 | A | 4/1986 | Tazaki | |
| 7,537,322 | B2 * | 5/2009 | Ishikawa et al. | 347/85 |
| 7,657,245 | B2 * | 2/2010 | Nakagawa et al. | 455/301 |
| 2001/0026304 | A1 | 10/2001 | Matsuzaki et al. | |
| 2005/0195242 | A1 * | 9/2005 | Samoto et al. | 347/37 |
| 2005/0195252 | A1 * | 9/2005 | Ishikawa et al. | 347/84 |
| 2005/0206667 | A1 | 9/2005 | Ohama et al. | |
| 2006/0192833 | A1 | 8/2006 | Samoto et al. | |
| 2006/0246866 | A1 * | 11/2006 | Nakagawa et al. | 455/301 |
| 2007/0139462 | A1 | 6/2007 | Tamaki | |
| 2007/0236552 | A1 * | 10/2007 | Suzuki et al. | 347/108 |
| 2010/0066796 | A1 * | 3/2010 | Yanagi et al. | 347/108 |

FOREIGN PATENT DOCUMENTS

| | | | |
|---|---|---|---|
| CN | 1663798 | A | 9/2005 |
| CN | 1665266 | A | 9/2005 |

(Continued)

OTHER PUBLICATIONS

Japan Patent Office, Notification of Reason for Refusal for Japanese Patent Application No. 2005-364688 (counterpart to co-pending U.S. Appl. No. 11/612,892), dispatched Feb. 22, 2011.

(Continued)

*Primary Examiner* — Matthew Luu
*Assistant Examiner* — Lily Kemathe
(74) *Attorney, Agent, or Firm* — Baker Botts L.L.P.

(57) ABSTRACT

An ink-jet recording apparatus, including: a recording portion movable to eject ink to perform image recording; flexible ink supply tube connected to the recording portion; and an ink-supply portion for supplying the ink to the ink supply tube. The ink supply tube includes first and second end portions respectively connected to the recording portion and the ink-supply portion. The ink supply tube extends at the first end portion in a first direction and is curved to extend to the ink-supply portion in a second direction, and a shape of the ink supply tube is changed following the movement of the recording portion. The ink-jet recording apparatus comprises a first board at least a portion of which overlaps, in plain view, an occupied area the ink supply tube can occupy while changing in shape, the first board including a controller for controlling the ink-jet recording apparatus.

11 Claims, 12 Drawing Sheets

(56) References Cited

FOREIGN PATENT DOCUMENTS

| | | | |
|---|---|---|---|
| CN | 1990240 | A | 7/2007 |
| EP | 1510350 | A1 | 3/2005 |
| GB | 2361670 | A | 10/2001 |
| JP | 2001-270132 | A | 10/2001 |
| JP | 2004-175072 | A | 6/2004 |
| JP | 2005-246883 | A | 9/2005 |
| JP | 2006231656 | A | 9/2006 |
| JP | 2006253511 | A | 9/2006 |
| JP | 2007-168095 | A | 7/2007 |
| JP | 2007-300603 | A | 11/2007 |
| JP | 2007-301822 | A | 11/2007 |
| JP | 2008-036898 | A | 2/2008 |
| JP | 2010-064437 | A | 3/2010 |
| WO | 9947356 | A1 | 9/1999 |

OTHER PUBLICATIONS

European Patent Office, European Search Report for EP Application No. 06026104.7 (counterpart to co-pending U.S. Appl. No. 11/612,892) mailed Mar. 2, 2007.

State Intellectual Property Office of the People's Republic of China, Notification of First Office Action for Chinese Patent Application No. 201210079262.2, mailed Apr. 28, 2014.

Japan Patent Office, Notification of Reasons for Rejection issued for Japanese Patent Application No. 2011-197160, mailed Dec. 16, 2014.

* cited by examiner

INK-JET RECORDING APPARATUS

CROSS REFERENCE TO RELATED APPLICATION

The present application claims priority from Japanese Patent Application No. 2011-197160, which was filed on Sep. 9, 2011, the disclosure of which is herein incorporated by reference in its entirety.

BACKGROUND OF THE INVENTION

1.Field of the Invention

The present invention relates to an ink-jet recording apparatus configured to eject droplets of ink from a recording head to record an image on a recording medium, and more particularly to an ink-jet recording apparatus capable of supplying the ink from an ink-supply portion to the recording head via an ink supply tube.

2.Description of the Related Art

There is conventionally known an ink-jet recording apparatus configured to eject droplets of ink from a recording head to record an image on a recording medium such as a recording sheet. In the ink-jet recording apparatus, the recording head is mounted on a carriage, so that the recording head, the carriage, and other components for recording constitute a recording portion. The carriage reciprocates in specific directions by receiving a driving power outputted from a drive source such as a motor. Upon the reciprocation of the carriage, the ink droplets are ejected from the recording head onto the recording medium. As a result, the image is recorded on the recording medium.

The ink is supplied to the recording portion from an ink-supply portion which is provided at a position different from the recording portion and to which an ink cartridge is connected. An ink supply method includes a method using an ink supply tube. The ink supply tube has a channel for supplying the ink from the ink-supply portion to the recording portion. The ink supply tube has flexibility allowing the ink supply tube to be moved or curved following the reciprocation of the carriage. The ink supply tube has a length corresponding to a position at which the carriage is located farthest from the ink-supply portion. When the carriage is located nearest to the ink-supply portion, the ink supply tube is curved so as to have a generally U-shape, for example.

Since the recording portion and the ink supply tube are designed as described above, the recording portion and the ink supply tube moved following the reciprocation of the carriage occupy a specific area upon the movement of the carriage. In particular, there is a need for a curved portion of the ink supply tube to have a relatively large curvature to prevent the ink supply tube from being bent into a plurality of parts in its movement following the movement of the carriage. Thus, an area occupied by the ink supply tube tends to become larger.

Further, operations of the ink-jet recording apparatus are controlled by a controller comprised of a microcomputer and other similar components. In general, the controller is mounted on a board.

There is an ink-jet recording apparatus including: a carriage; a recording head mounted on the carriage; a tube corresponding to the above-described ink supply tube; and a main board serving as a controller.

SUMMARY OF THE INVENTION

In this ink-jet recording apparatus, the carriage is movable in a widthwise direction of the apparatus in plan view. The ink supply tube is disposed on a front side of the carriage. The main board is disposed on a front side of the ink supply tube.

Here, the carriage and the ink supply tube occupy a specific area upon the movement of the carriage as described above. Further, the main board also occupies a specific area. Thus, if the ink supply tube is disposed on a front side of the carriage, and the main board is disposed on a front side of the ink supply tube, the ink-jet recording apparatus has a relatively long length in its frontward and rearward directions. That is, a footprint of the ink-jet recording apparatus is disadvantageously made larger.

This invention has been developed to provide an ink-jet recording apparatus capable of suppressing an increase in a footprint of the apparatus even where an ink supply tube for supplying ink from an ink-supply portion to a recording portion is disposed in the apparatus.

The present invention provides an ink-jet recording apparatus comprising: An ink-jet recording apparatus, including: a recording portion movable in directions along an image recording face of a recording medium and configured to eject droplets of ink to record an image on the recording medium; at least one flexible ink supply tube connected to the recording portion for supplying the ink to the recording portion therethrough; and an ink-supply portion configured to supply the ink to the at least one ink supply tube, wherein the at least one ink supply tube includes: a first end portion connected to the recording portion; and a second end portion connected to the ink-supply portion, wherein the at least one ink supply tube extends at the first end portion in a first direction and is curved so as to extend to the ink-supply portion in a second direction that is different from the first direction, and a shape of the at least one ink supply tube is changed following the movement of the recording portion, and wherein the ink-jet recording apparatus further comprises a first board at least a portion of which is disposed at a position overlapping, in plain view, an occupied area that is an area the at least one ink supply tube is allowed to occupy while changing in shape, the first board including a controller configured to control operations of the ink-jet recording apparatus.

An area occupied by the first board and an area the at least one ink supply tube is allowed to occupy while changing in shape in plan view can be shared.

BRIEF DESCRIPTION OF THE DRAWINGS

The objects, features, advantages, and technical and industrial significance of the present invention will be better understood by reading the following detailed description of the embodiment of the invention, when considered in connection with the accompanying drawings, in which:

FIGS. 7A and 7B are views each schematically showing a positional relationship among a recording portion 24, ink supply tubes 30, a cartridge mount 41, a plate 70, a first board 80, and a second board 81 when the carriage 38 is located at the right end portion of the printing section 11, wherein FIG. 7A is a plan view showing the positional relationship, and FIG. 7B is a front elevational view showing the positional relationship.

FIGS. 8A and 8B are views schematically showing the positional relationship among the recording portion 24, the ink supply tubes 30, the cartridge mount 41, the plate 70, the first board 80, and the second board 81 when the carriage 38 is located at the left end portion, wherein FIG. 8A is a plan view showing the positional relationship, and FIG. 8B is a front elevational view showing the positional relationship.

DETAILED DESCRIPTION OF THE EMBODIMENT

Hereinafter, there will be described an embodiment of the present invention by reference to the drawings. It is to be understood that the following embodiment is described only by way of example, and the invention may be otherwise embodied with various modifications without departing from the scope and spirit of the invention. In the following explanation, a term "direction" means a direction indicated by a single-pointed arrow, and a term "directions" means directions indicated by a double-pointed arrow. Further, in the following explanation, there will be expressed (a) upward and downward directions 7 on the basis of a state in which a multi-function device (NEED) 10 is normally used or placed (i.e., a state of the MFD 10 in FIG. 1), (b) frontward and rearward directions 8 by regarding a side of the MFD 10 on which a main-body opening 13 is provided as a front side, and (c) rightward and leftward directions 9 in a state in which the MFD 10 is seen from the front side thereof.

<MFD 10>

Figure 1:
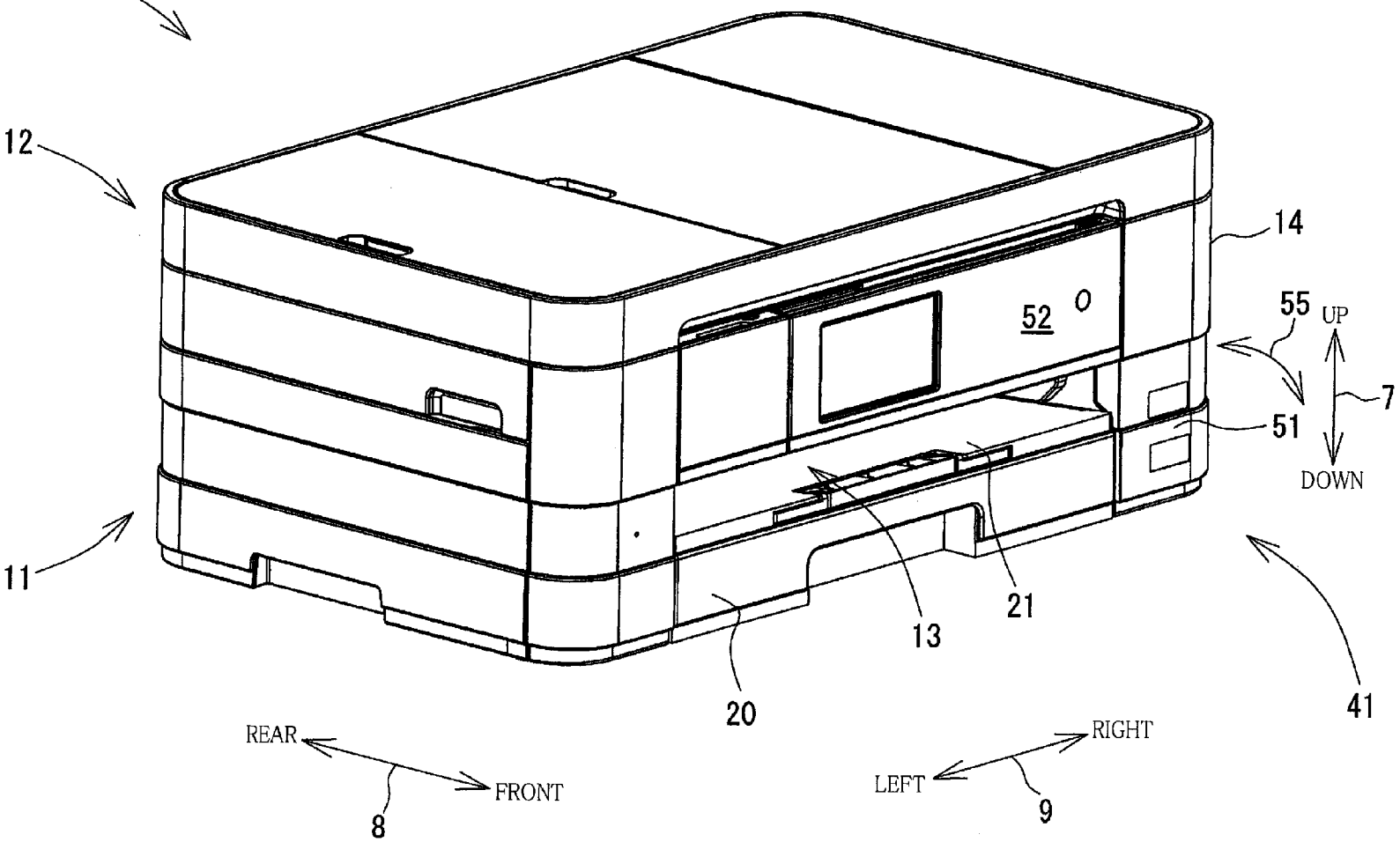
FIG. 1 is an external perspective view of an MFD 10.

As shown in FIG. 1, the MFD 10 has a generally rectangular parallelepiped shape so as to have a low profile. The MFD 10 includes, at its upper portion, a scanning section 12 configured to obtain image data by using an image sensor to read an image recorded on a document sheet such as a recording sheet. The MFD 10 further includes, at its lower portion, a printing section 11 (as one example of an ink-jet recording apparatus) configured to record an image on a recording sheet 15 as one example of a recording medium (see FIG. 2) on the basis of the image data, for example. The MFD 10 includes a casing 14 having the main-body opening 13 formed in its front face. A sheet-supply tray 20 and a sheet-discharge tray 21 can be inserted and removed through the main-body opening 13 in the frontward and rearward directions 8. The recording sheet(s) 15 of a desired size is or are placed or stacked on the sheet-supply tray 20.

The scanning section 12 is provided by what is called a flatbed scanner. It is noted that a detailed explanation of the scanning section 12 is dispensed with.

Figure 2:
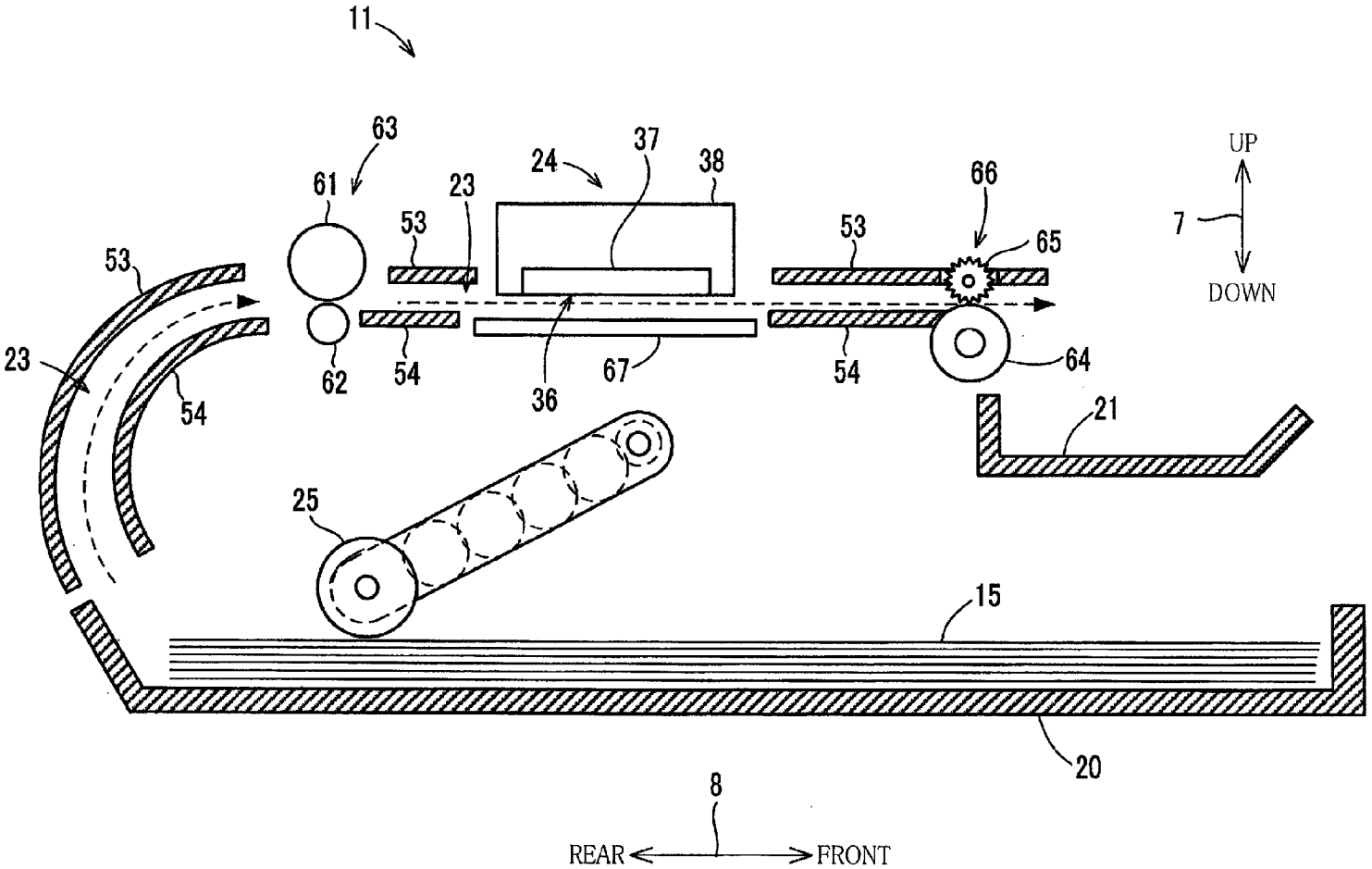
FIG. 2 is an elevational view in vertical cross section schematically showing an internal structure of a printing section 11.

As shown in FIG. 2, the printing section 11 includes: (a) a conveyance path 23 through which the recording sheet 15 is conveyed; (b) a sheet-supply roller 25 rotatable to supply an uppermost one of the recording sheets 15 stacked on the sheet-supply tray 20; (c) a conveyance roller pair 63 and a discharge roller pair 66 provided in the conveyance path 23 so as to convey the recording sheet 15 supplied into the conveyance path 23 by the sheet-supply roller 25; and (d) an ink-jet recording portion 24 configured to record the image on the recording sheet 15 on the basis of the image data obtained by the scanning section 12 from the document.

<Conveyance Path 23>

As shown in FIG. 2, the conveyance path 23 is a path that extends upward from a rear end portion of the sheet-supply tray 20, makes a U-turn, and then extends frontward through a position under the recording portion 24 to reach the sheet-discharge tray 21. The conveyance path 23 is a space defined by an outer guide member 53 and an inner guide member 54 opposed to each other with a predetermined distance. The recording sheet 15 is conveyed through the conveyance path 23 in a conveyance direction indicated by broken lines in FIG. 2.

<Conveyance Roller Pair 63 and Discharge Roller Pair 66>

As shown in FIG. 2, the conveyance roller pair 63 including a conveyance roller 61 and a pinch roller 62 is provided in the conveyance path 23 on an upstream side of the recording portion 24 in the conveyance direction. The pinch roller 62 is held in pressing contact with a roller face of the conveyance roller 61 by an elastic member, not shown, such as a spring. As a result, the conveyance roller pair 63 can nip the recording sheet 15.

The discharge roller pair 66 including a discharging roller 64 and a spur 65 is provided in the conveyance path 23 on a downstream side of the recording portion 24 in the conveyance direction. The spur 65 is held in pressing contact with a roller face of the discharging roller 64 by an elastic member, not shown, such as a spring. As a result, the discharge roller pair 66 can nip the recording sheet 15.

The conveyance roller 61 and the discharging roller 64 are rotated by a driving power of a conveyance motor, not shown, which is transmitted via a drive-power transmitting mechanism, not shown, including a planetary gear and other transmitting components. The conveyance roller 61 and the discharging roller 64 rotated by the driving power convey the recording sheet 15 in the conveyance direction while nipping the sheet 15 respectively with the pinch roller 62 and the spur 65.

<Recording Portion 24>

As shown in FIG. 2, the recording portion 24 is disposed on an upper side of the conveyance path 23. The recording portion 24 includes an ink-jet recording head 37 and a carriage 38 on which the recording head 37 is mounted.

As shown in FIGS. 3-6, the carriage 38 is supported on guide rails 43, 44 (which will be described below) so as to be movable in the rightward and leftward directions 9 perpendicular to the frontward and rearward directions 8 as the conveyance direction in which the recording sheet 15 is conveyed. In other words, the carriage 38 is supported by a pair of the guide rails 43, 44 so as to be movable in directions along a face of the recording sheet 15 on which the image is to be recorded (as one example of an image recording face).

The guide rails 43, 44 are disposed so as to be opposed to each other in the frontward and rearward directions 8 and extend in the rightward and leftward directions 9. The guide rails 43, 44 are mounted on a frame 72 that is for supporting components of the printing section 11. The carriage 38 is mounted so as to bridge the guide rails 43, 44 and to be movable in the rightward and leftward directions 9.

Figure 5:
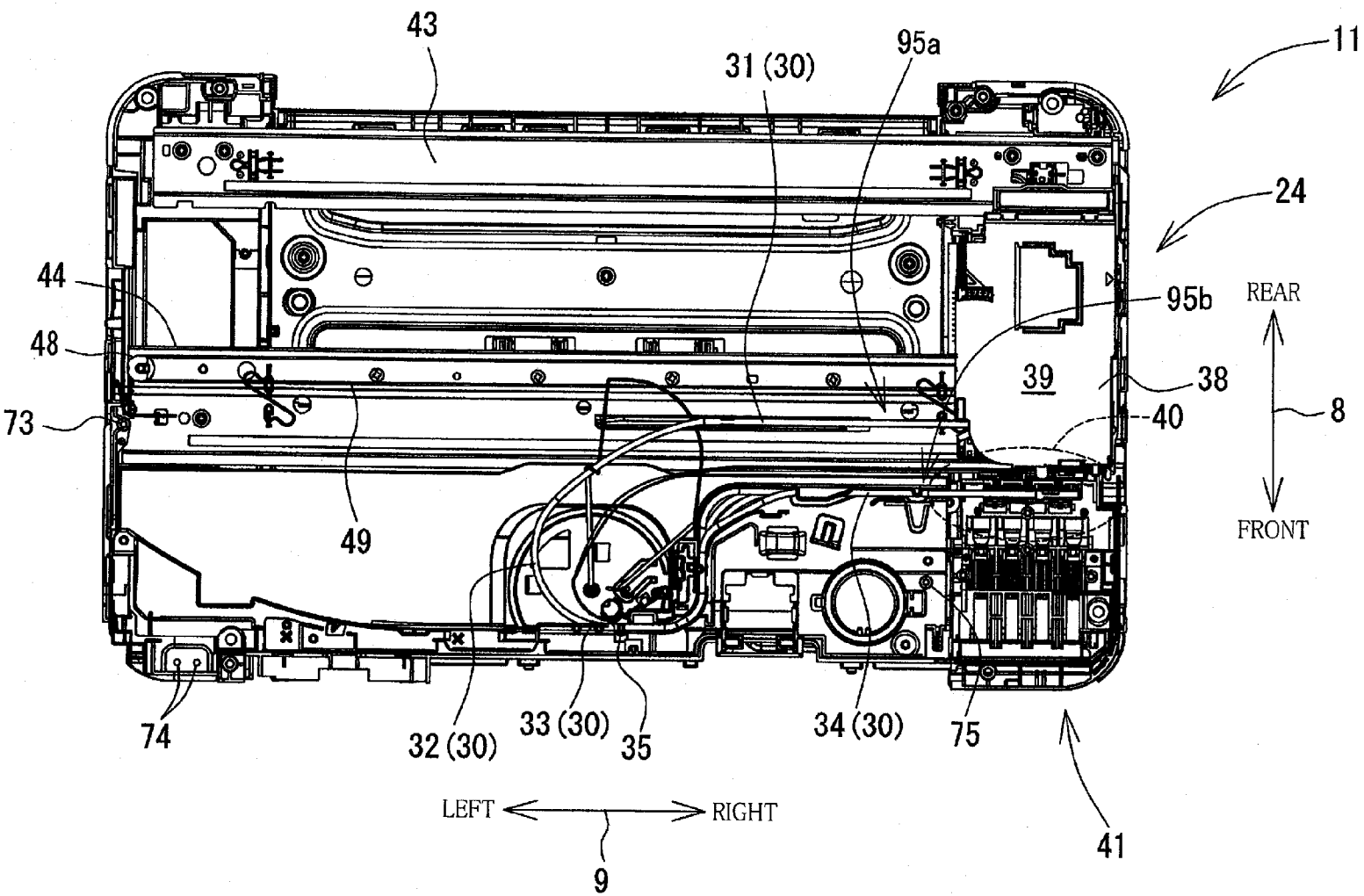
FIG. 5 is a plan view showing the printing section 11 when a carriage 38 is located at a right end portion of the printing section 11.
Figure 6:
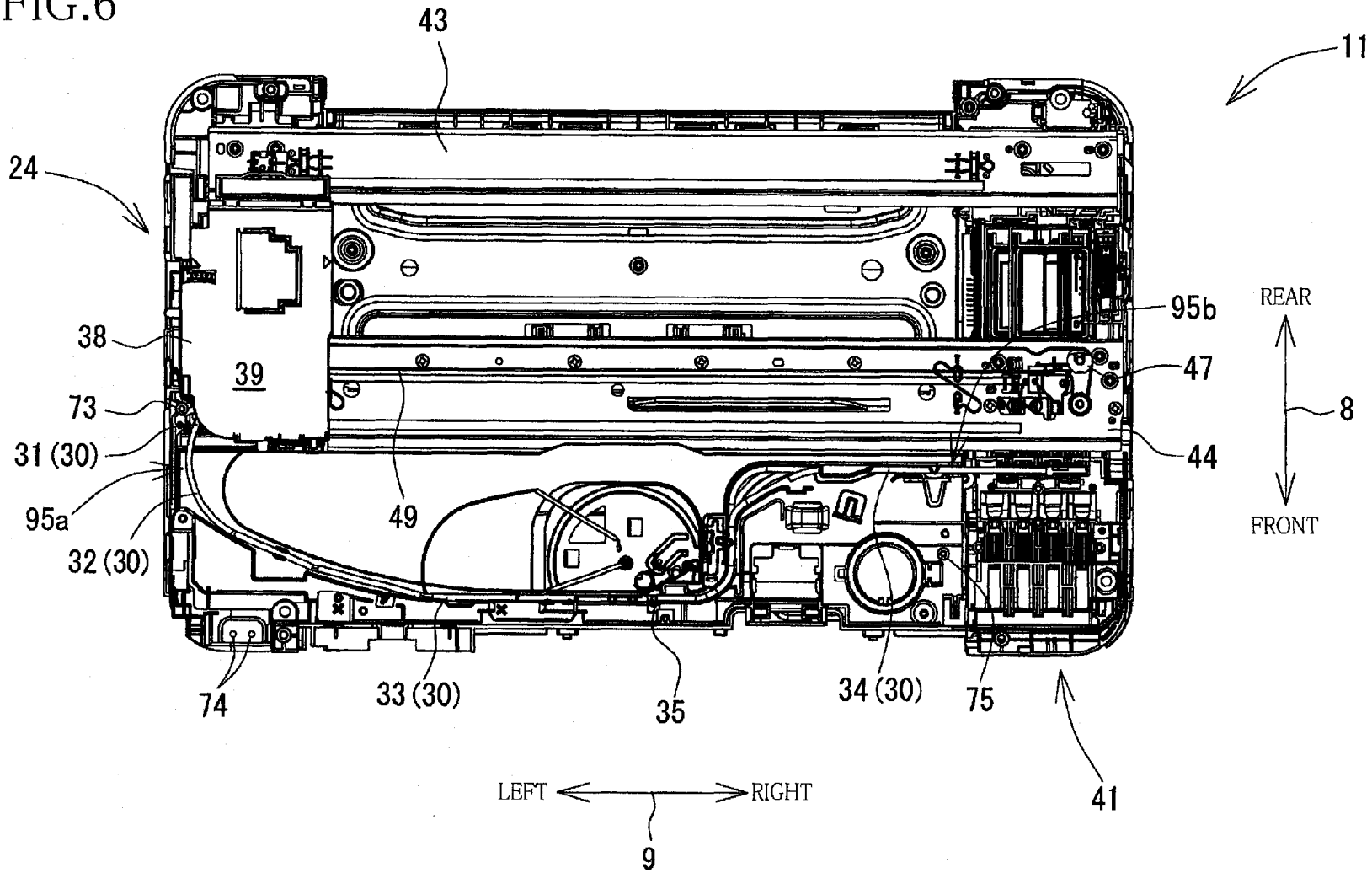
FIG. 6 is a plan view showing the printing section 11 when the carriage 38 is located at a left end portion of the printing section 11.

On an upper face of the guide rail 44 are disposed a drive pulley 47 (see FIG. 6), a driven pulley 48 (see FIG. 5), and an endless belt 49 (see FIGS. 5 and 6). The drive pulley 47 and the driven pulley 48 are respectively mounted on opposite end portions of the guide rail 44 in the rightward and leftward directions 9. The belt 49 is looped over the drive pulley 47 and the driven pulley 48. The drive pulley 47 has a shaft to which is connected a drive shaft of a carriage motor, not shown, for driving the carriage 38. When a driving power of the carriage motor has been transmitted to the drive pulley 47, the drive pulley 47 is rotated, causing a rotation of the belt 49.

The carriage 38 is connected at its bottom face to the belt 49. Thus, the rotation of the belt 49 moves the carriage 38 on the guide rails 43, 44 in the rightward and leftward directions 9. That is, the carriage 38 and the recording head 37 mounted thereon are moved in the rightward and leftward directions 9.

As shown in FIG. 2, the recording head 37 is disposed on a lower face of the carriage 38. A multiplicity of nozzles are formed in a lower face of the recording head 37. The nozzles are exposed from the lower face of the carriage 38. That is, the recording head 37 has a nozzle face 36 having the nozzles formed therein.

Inks of respective colors are supplied to the recording portion 24 respectively from ink cartridges 90 mounted on a cartridge mount 41 (see FIGS. 3-6) which will be described below, through ink supply tubes 30 which will be described below. During the sliding movement of the carriage 38, the recording head 37 selectively ejects fine ink droplets from the nozzles to record the image on the recording sheet 15 conveyed on a platen 67 (see FIG. 2).

<Cartridge Mount 41>

Figure 3:
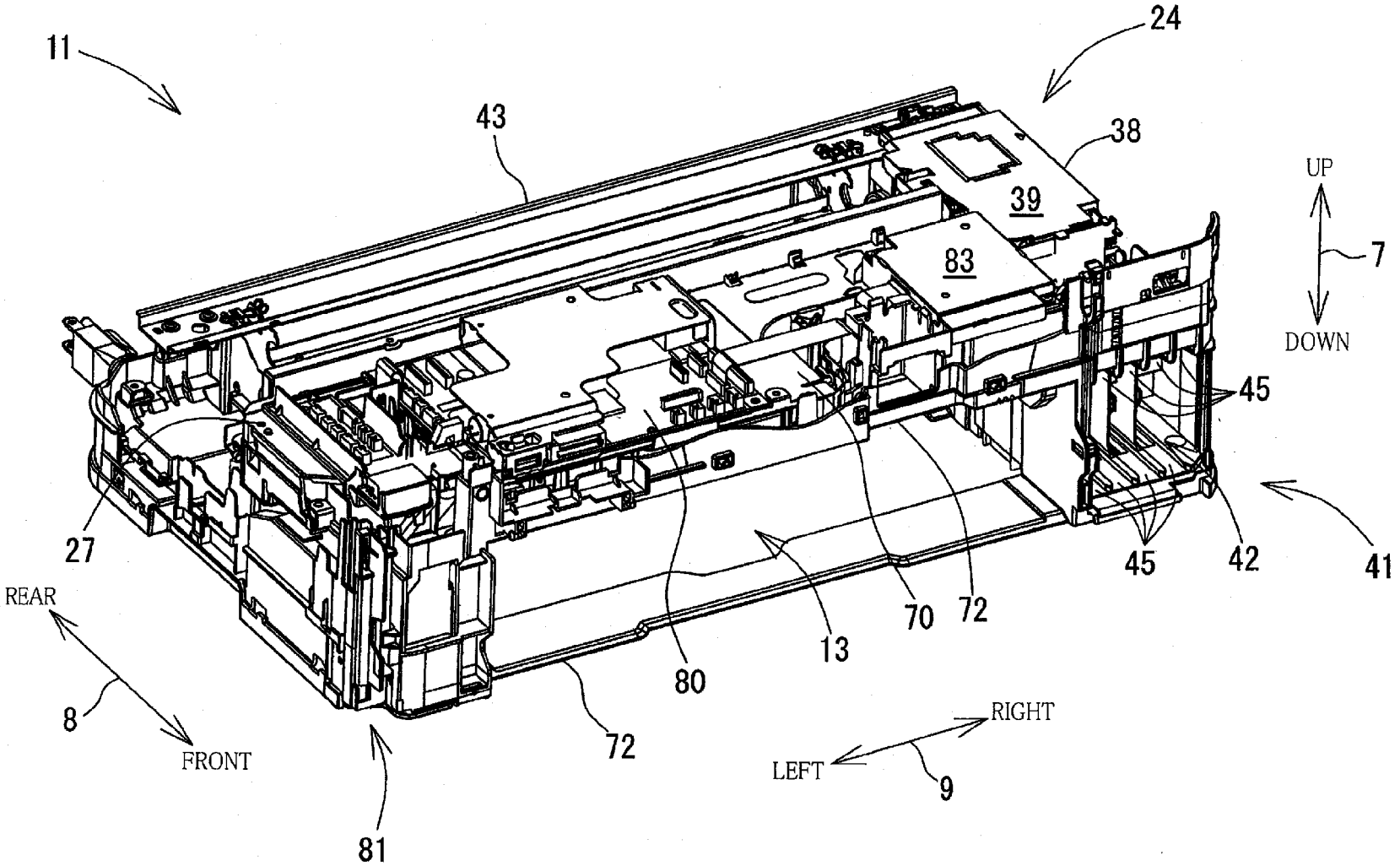
FIG. 3 is a perspective view showing an inside of the printing section 11 when seen from a front left upper side thereof.
Figure 4:
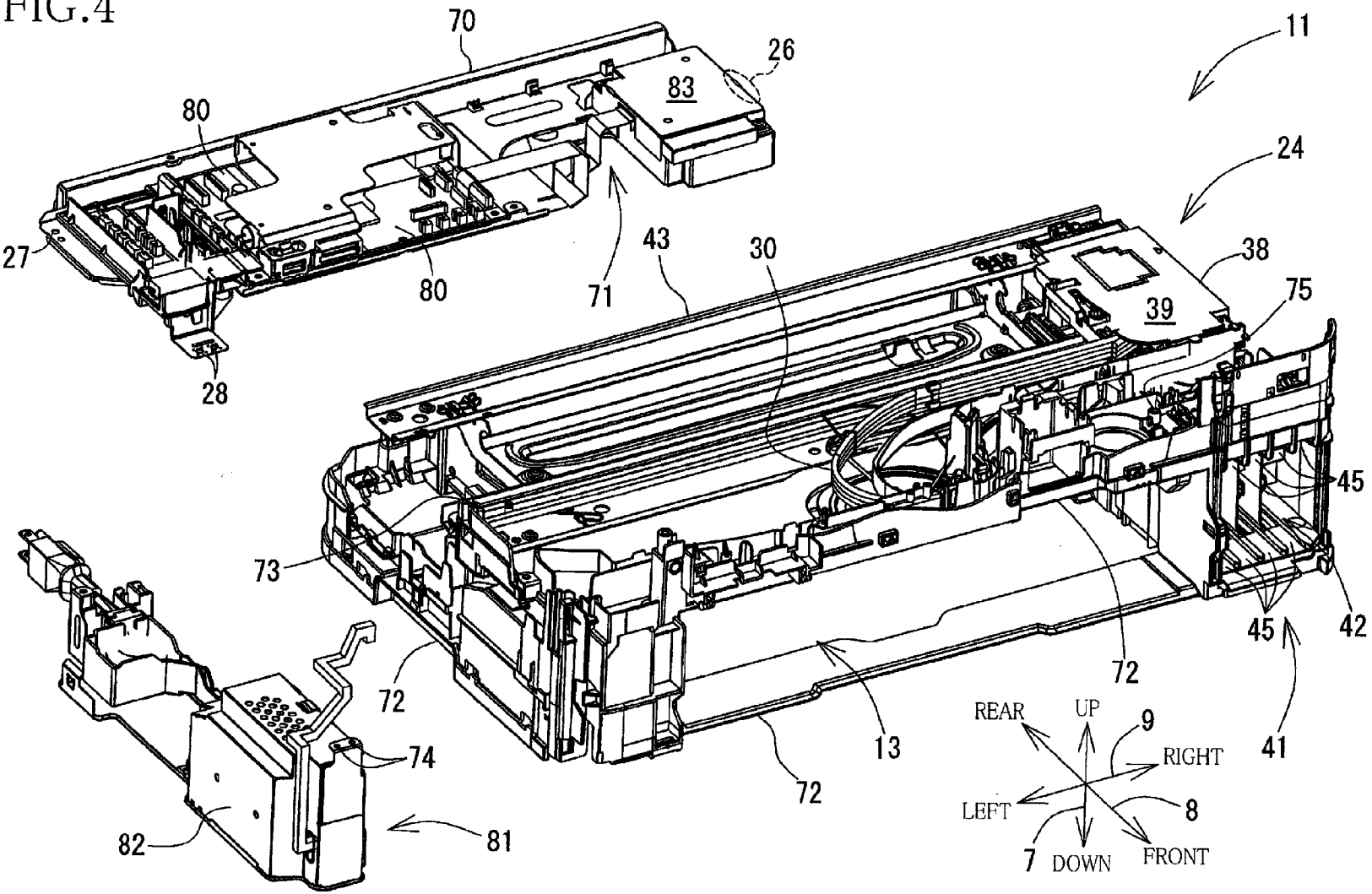
FIG. 4 is an exploded perspective view showing the inside of the printing section 11 in FIG. 3.
Figure 12:
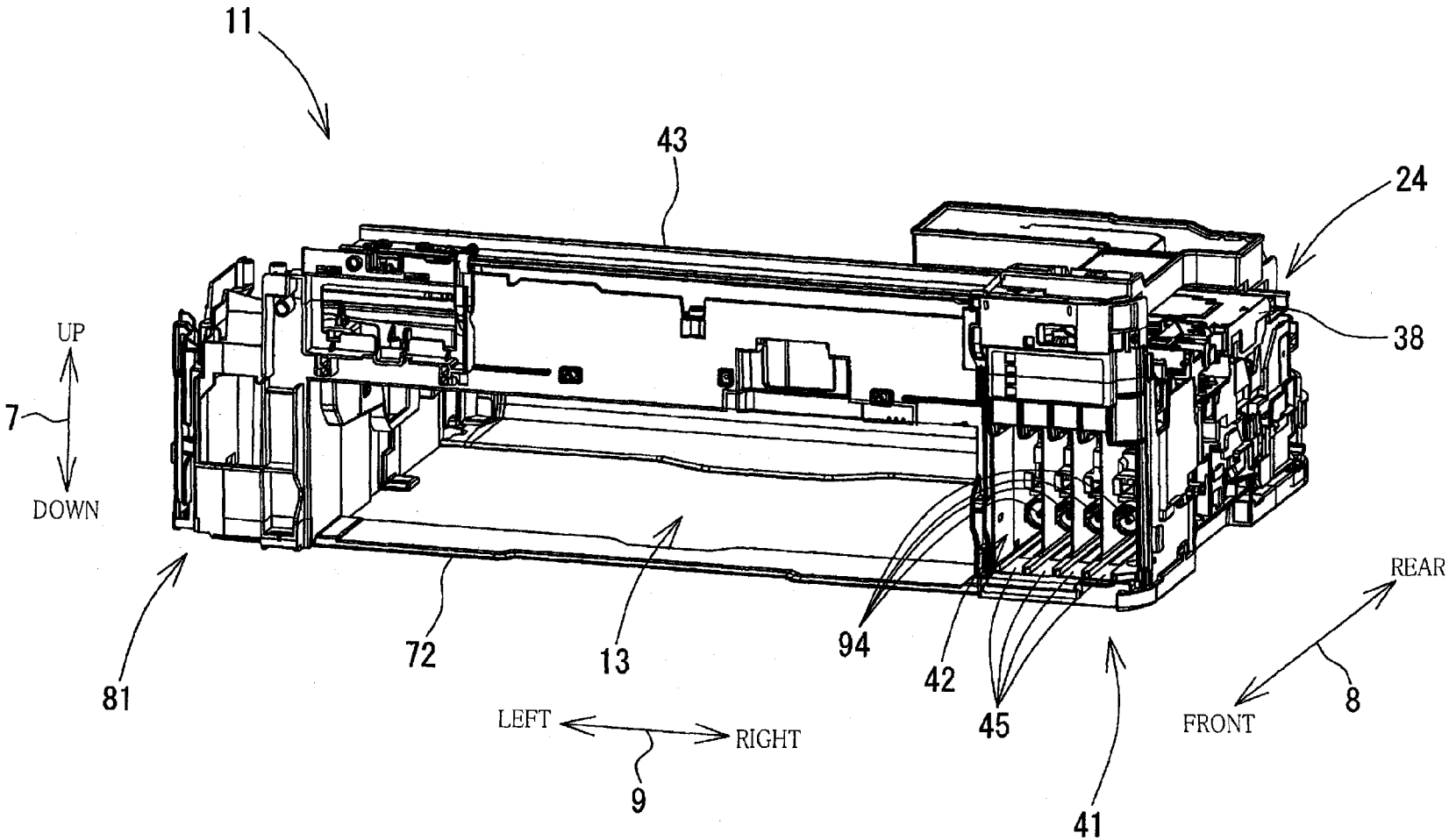
FIG. 12 is a perspective view showing the inside of the printing section 11 when seen from a front right upper side thereof.

As shown in FIGS. 1, 3, 4, and 12, the cartridge mount 41 is provided on a lower right side of a front face 52 (see FIG. 1) of the printing section 11. As shown in FIG. 1, a cover 51 is provided on a lower right side of the front face 52 of the printing section 11. The cover 51 is opened and closed by its pivotal movement in directions indicated by arrow 55 about a lower end of the front face 52 of the printing section 11 as an axis. As shown in FIGS. 3, 4, and 12, when the cover 51 is open, the cartridge mount 41 is exposed.

Figure 11:
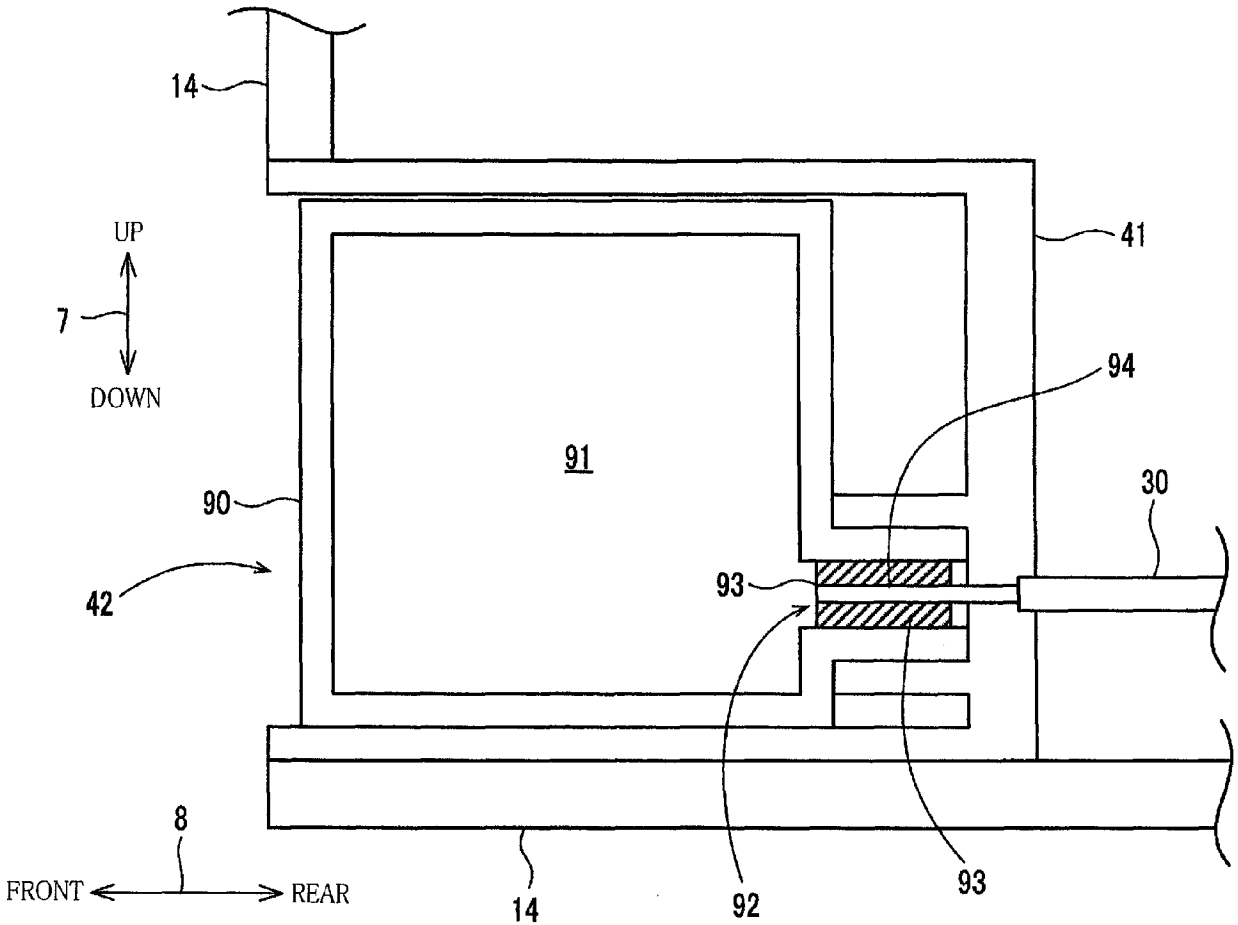
FIG. 11 is an elevational view in vertical cross section schematically showing an ink cartridge 90 and the cartridge mount 41.

As shown in FIG. 11, the ink cartridges 90 are mountable on and removable from the cartridge mount 41. Each of the ink cartridges 90 has a generally rectangular parallelepiped shape. Specifically, the ink cartridge 90 is shorter in length in its widthwise direction than in its height direction or in its depth direction, that is, the ink cartridge 90 is slim in its widthwise direction. Since the four cartridges 90 have the same construction, the following explanation will be given for one of the cartridges 90 for the sake of simplicity unless otherwise required by context.

An ink chamber 91 is formed in the ink cartridge 90. The ink is stored in the ink chamber 91. When the ink cartridge 90 is inserted into and removed from the cartridge mount 41, a widthwise direction, a height direction, and a depth direction of the ink cartridge 90 respectively coincide with the rightward and leftward directions 9, the upward and downward directions 7, and the frontward and rearward directions 8.

An ink-supply opening 92 is formed in a rear wall of the ink cartridge 90 so as to communicate with the ink chamber 91. The ink-supply opening 92 is opened and closed by an ink-supply valve 93.

As shown in FIGS. 3, 4, and 12, the cartridge mount 41 is a box-like member having a generally rectangular parallelepiped shape and has an opening 42. The cartridge mount 41 is mounted on a right side of the main-body opening 13 of the casing 14 of the printing section 11 such that the opening 42 is located on a front side.

The ink cartridge 90 is inserted into and removed from the cartridge mount 41 through the opening 42. Guide grooves 45 are formed in a top face and a bottom face of the cartridge mount 41. The ink cartridge 90 is inserted and removed along the guide grooves 45. In the present embodiment, the four guide grooves 45 are formed in each of the top face and the bottom face of the cartridge mount 41. In the present embodiment, the four ink cartridges 90 respectively storing the inks of respective four colors, namely, cyan, magenta, yellow, and black can be inserted into and removed from the cartridge mount 41.

As shown in FIGS. 11 and 12, ink needles 94 are projected from a rear inside face of the cartridge mount 41. The ink needles 94 are arranged on the rear inside face at respective positions corresponding to the respective ink-supply openings 92 of the ink cartridges 90 mounted on the cartridge mount 41.

As shown in FIG. 11, each of the ink needles 94 is connected to a corresponding one of the ink supply tubes 30 in a rear portion of the cartridge mount 41 at a position nearer to a rear outside face of the cartridge mount 41 than its rear inside face. As will be described below, the ink supply tubes 30 drawn rearward from the respective ink needles 94 communicate with the recording portion 24.

When the ink cartridge 90 has been mounted on the cartridge mount 41, the ink needle 94 provided on the cartridge mount 41 is inserted into the ink-supply opening 92 of the ink cartridge 90, thereby opening the ink-supply valve 93. As a result, the ink stored in the ink chamber 91 flows toward the ink needle 94 so as to be supplied to the recording portion 24 through the ink supply tube 30.

<Ink Supply Tubes 30>

As described above, the ink cartridges 90 storing the respective inks therein are mounted on the cartridge mount 41 of the printing section 11. As shown in FIGS. 4-8B, the four ink supply tubes 30 respectively for the inks of respective colors are drawn or routed from the cartridge mount 41 to the respective carriages 38. The inks are supplied to the recording head 37 mounted on the carriage 38, through the respective ink supply tubes 30 connected to the respective carriages 38.

Each of the ink supply tube 30 is a tube formed of a synthetic resin and having a straight shape. The ink supply tube 30 has a resilience (flexural rigidity) suitable for maintaining the straight shape. Specifically, the ink supply tube 30 has: flexibility allowing the ink supply tube 30 to be curved or bent when an external force is applied thereto; and elasticity allowing the ink supply tube 30 to return its original shape after the applied external force is released. These flexibility and elasticity allow the ink supply tubes 30 to change its shape (posture) following the reciprocation of the carriage 38.

As shown in FIGS. 5 and 6, the ink supply tubes 30 drawn from a rear side of the cartridge mount 41 (i.e., an area enclosed by a broken line designated by reference numeral 40 in FIG. 5) are temporarily fastened by a clip 35 provided on the printing section 11. A portion of each ink supply tube 30 from the clip 35 to the carriage 38 can be freely curved or bent without being fastened or secured to the component of the printing section 11 such as the frame 72. That is, this portion changes in shape following the reciprocation of the carriage 38.

The ink supply tubes 30 is drawn such that the portion thereof from the clip 35 to the carriage 38 has a generally U-shape (or J-shape) so as to extend leftward from the clip 35, then make a U-turn, and extend rightward. Further, as shown in FIG. 4, the four ink supply tubes 30 are stacked on one another in the upward and downward directions 7. In other words, the four ink supply tubes 30 are arranged in a row in the upward and downward directions 7.

Figure 8A:
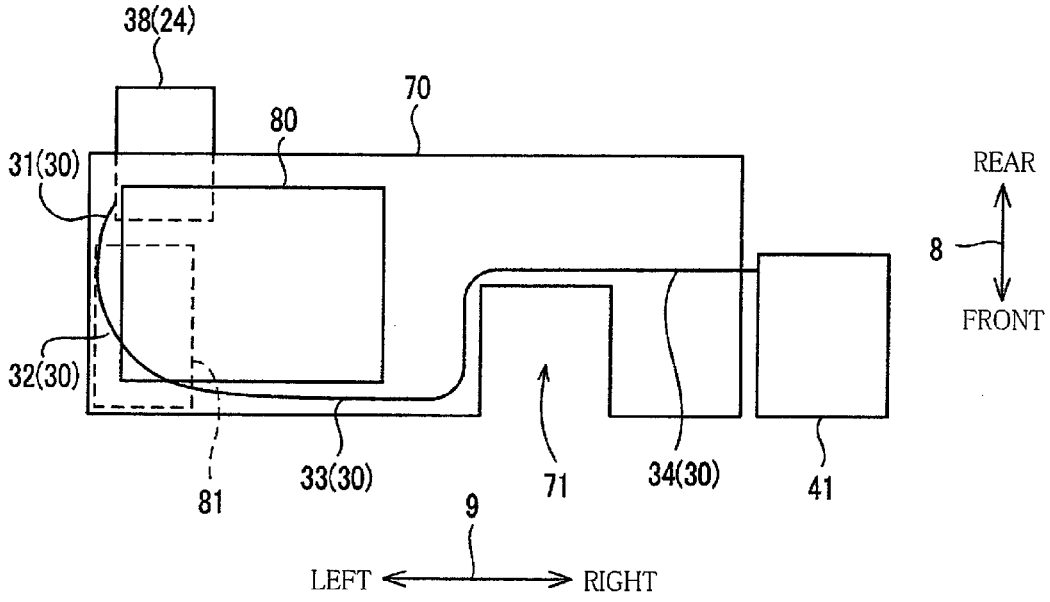
Figure 8B:
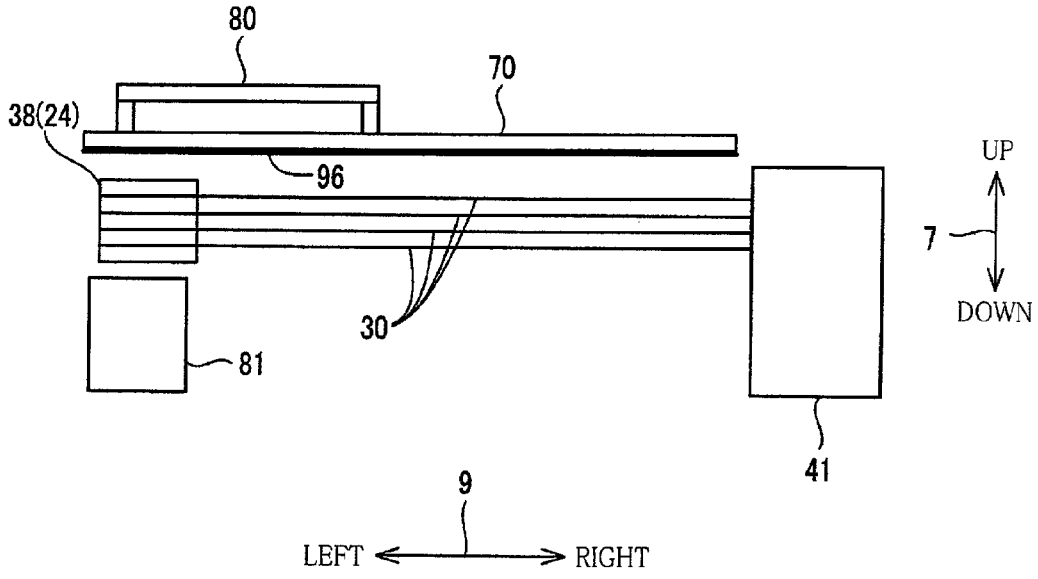

It is noted that the four ink supply tubes 30 only need to be arranged in the upward and downward directions 7 at least in an area under a first board 80 in an occupied area 76 (which will be described below) of the ink supply tubes 30 in FIG. 9. In FIGS. 6 and 8A, 8B, the four ink supply tubes 30 are arranged in the upward and downward directions 7 in an area under the first board 80 and overlapping a second board 81 which will be described below in plan view in the occupied area 76.

In the following explanation, as shown in FIGS. 5 and 6, a portion of each ink supply tube 30 which extends from a first end portion 95*a* thereof connected to the carriage 38 in a leftward direction (as one example of a first direction) is hereinafter referred to as a first portion 31, a portion of each ink supply tube 30 which is elastically curved in a direction having downward and leftward components, in a direction having the downward component, and in a direction having downward and rightward components in order from the first portion 31 so as to finally extend in a rightward direction (as one example of a second direction) is hereinafter referred to as a second portion 32, a portion of each ink supply tube 30 which extends rightward from the second portion 32 to the portion thereof fastened by the clip 35 is hereinafter referred to as a third portion 33, and a portion of each ink supply tube 30 which extends from the third portion 33 to a second end portion 95*b* thereof connected to a corresponding one of the ink needles 94 of the cartridge mount 41 is hereinafter referred to as a fourth portion 34.

Figure 7A:
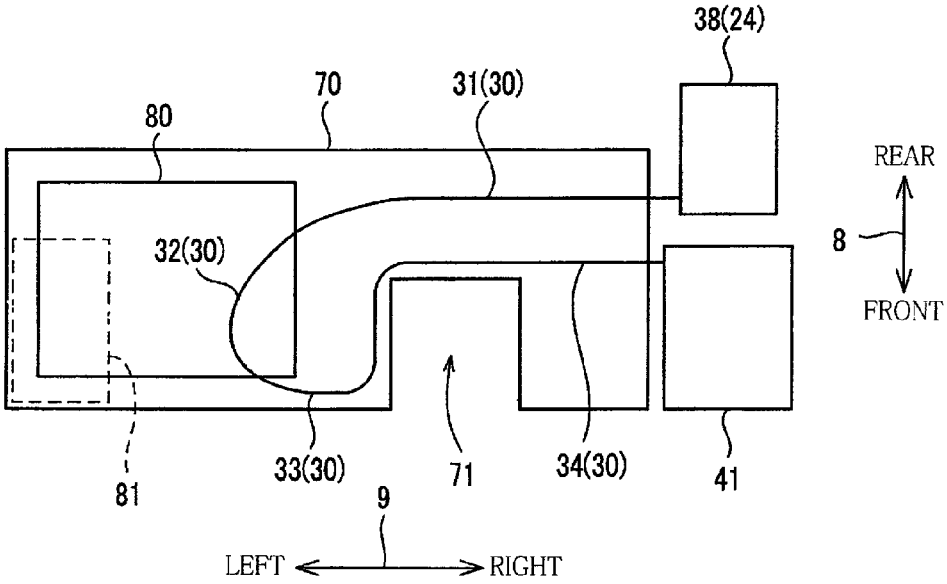

When the carriage 38 is reciprocated, the first portion 31, the second portion 32, the third portion 33 of the ink supply tubes 30 follow the reciprocation, and thereby the shape of the ink supply tubes 30 changes. Specifically, a degree of the curvature of the U-shape of the ink supply tubes 30 is changed. This change in shape changes areas in plan view respectively occupied or taken up by the first portion 31, the second portion 32, and the third portion 33. For example, as shown in FIGS. 5 and 7A, when the carriage 38 has been moved to a right end portion of the printing section 11 in FIG. 5, the area occupied by the first portion 31 becomes longer, and the area occupied by the third portion 33 becomes shorter. On the other hand, as shown in FIGS. 6 and 8A, when the carriage 38 has been moved to a left end portion of the printing section 11 in FIG. 6, the area occupied by the first portion 31 becomes shorter, and the area occupied by the third portion 33 becomes longer.

Figure 9:
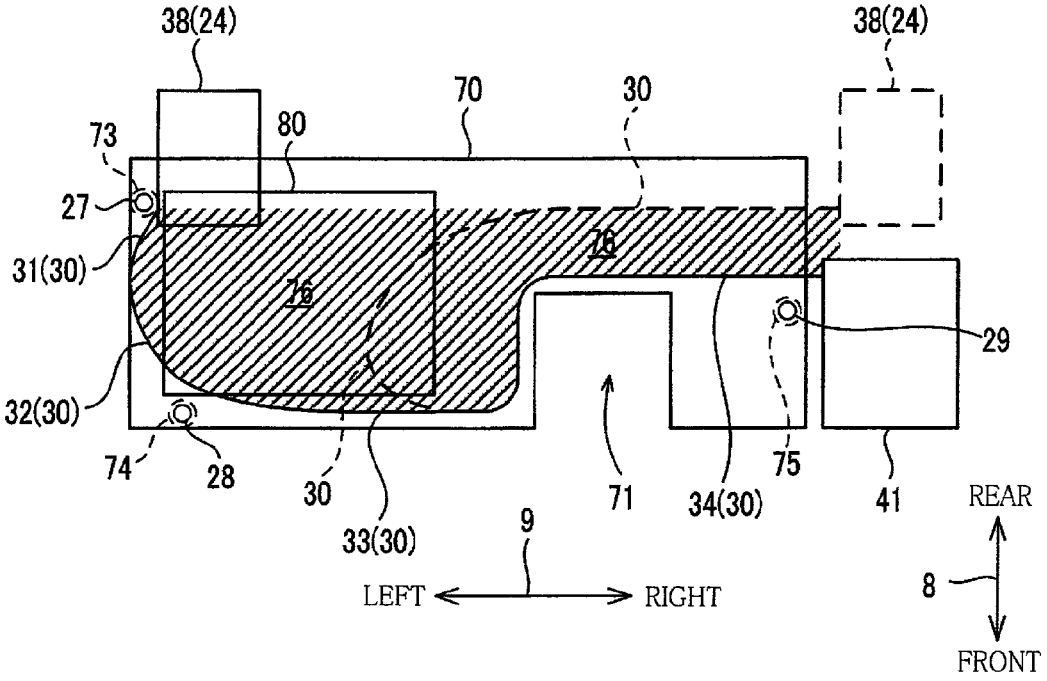
FIG. 9 is a plan view showing the printing section 11, wherein a state in which the carriage 38 is located at the left end portion of the printing section 11 and a state in which the carnage 38 is located at the right end portion of the printing section 11 are superposed on each other.

In view of the above, as shown in FIG. 9, the area that can be occupied by the ink supply tubes 30 whose shape is changed is the occupied area 76 represented by a hatched area in FIG. 9.

The first end portion 95*a* of each ink supply tube 30 is connected to the carriage 38 with a joint, not shown. It is noted that this joint is hidden by an upper cover 39 of the carriage 38 and not illustrated in FIGS. 3-6. The joint is provided in the recording portion 24 so as to communicate with the recording head 37.

In view of the above, in the present embodiment, the cartridge mount 41 to which the second end portion 95*b* of the ink supply tube 30 is connected is one example of an ink-supply portion for supplying the ink to the ink supply tubes 30.

It is noted that, in the present embodiment, mounting the ink cartridge 90 on the cartridge mount 41 enables the ink to be supplied to the recording portion 24. However, a configuration for supplying the ink to the recording portion 24 is not limited to the configuration described above. For example, an ink tank communicating with the ink supply tubes 30 may be provided instead of the cartridge mount 41 at a position at which the cartridge mount 41 is disposed. In this case, the second end portion 95*b* of the ink supply tube 30 is connected to the ink tank. Accordingly, in this case, the ink tank is one example of the ink-supply portion.

<Plate 70>

As shown in FIGS. 3 and 4, a plate 70 formed of a metal such as iron and stainless steel is disposed on the printing section 11. The plate 70 is provided by a thin plate that is longer in the frontward and rearward directions 8 or in the rightward and leftward directions 9 than in the upward and downward directions 7. In the present embodiment, the plate 70 has a cutout 71 (see FIG. 4) formed therein, but the plate 70 has a generally rectangular shape.

The first board 80 which will be described below is mounted on a portion of an upper face of the plate 70, which portion is located on a left side of the cutout 71. The plate 70 is disposed so as to cover the ink supply tubes 30 from an upper side thereof. That is, as shown in FIGS. 7A-8B, the plate 70 is disposed over the ink supply tubes 30. In view of the above, the plate 70 is provided between the first board 80 and the ink supply tubes 30 in the upward and downward directions 7.

It is noted that the plate 70 has the generally rectangular shape in the present embodiment but may alternatively have any other suitable shape. Further, the plate 70 may have not only the cutout 71 but also an opening(s) and/or a bend.

At least three holes are defined in the plate 70. In the present embodiment, three holes are formed. FIG. 4 shows two holes 27, 28. The other hole 29 (see FIG. 9) is not illustrated in FIG. 4 but is formed in an area designated by reference numeral 26 in FIG. 4. Specifically, as shown in FIG. 4, the plate 70 is covered with a cover plate 83 from an upper side of the plate 70, and the hole 29 is formed in the plate 70 under the cover plate 83. It is noted that FIG. 9 shows all the three holes 27, 28, 29. Screws, not shown, are respectively inserted into the three holes 27, 28, 29 from an upper side thereof. The screws are respectively screwed into protruding portions 73, 74, 75 (see FIGS. 4-6 and 9) formed in the frame 72 of the printing section 11 which will be described below.

<Protruding Portions 73, 74, 75>

As shown in FIGS. 4-6, the protruding portions 73, 74, 75 projecting upward are provided on the frame 72 of the printing section 11. In the present embodiment, as shown in FIG. 9, the protruding portions 73, 74, 75 located outside the occupied area 76 in the frontward and rearward directions 8 and in the rightward and leftward directions 9, i.e., in plan view.

Specifically, as shown in FIG. 9, the protruding portions 73, 74 are provided outside the second portion 32 as one example of a curved portion of the ink supply tube 30 in plan view. Here, where the curved portion is a segment of a circle, the outside of the curved portion of the ink supply tube 30 is a side of the curved portion on which a center of the circle does not exist. That is, in the present embodiment, the outside of the curved portion of the ink supply tube 30 is a left side of the second portion 32.

The protruding portion 75 is provided inside the second portion 32 as one example of the curved portion of the ink supply tube 30 in plan view. Here, where the curved portion is a segment of a circle, the inside of the curved portion of the ink supply tube 30 is a side of the curved portion on which a center of the circle exists. That is, in the present embodiment, the inside of the curved portion of the ink supply tube 30 is a right side of the second portion 32.

There will be next explained a support of the plate 70 by the protruding portions 73, 74, 75 in the present embodiment. A positional relationship among the protruding portions 73, 74, 75 is the same as a positional relationship among the holes formed in the plate 70. A hole or holes are formed in an upper face of each of the protruding portions 73, 74, 75. Each screw inserted into the corresponding hole of the plate 70 from an upper side thereof is fastened in a corresponding one of the holes formed in the upper faces of the protruding portions 73, 74, 75 of the frame 72.

As a result, the plate 70 is supported by the protruding portions 73, 74, 75 of the frame 72 of the printing section 11. In other words, the protruding portions 73, 74, 75 support the plate 70 from a side of the plate 70 on which the ink supply tubes 30 exist, i.e., from a lower side of the plate 70. Specifically, the protruding portions 73, 74, 75 support the plate 70 at two positions (i.e., the protruding portions 73, 74) outside the second portion 32 of the ink supply tube 30 in plan view and a single position (i.e., the protruding portion 75) inside the second portion 32 of the ink supply tube 30 in plan view. In view of the above, the protruding portions 73, 74, 75 of the frame 72 are one example of a support portion.

<First Board 80>

As shown in FIGS. 3 and 4, the first board 80 is screwed or secured to the upper face of the metal plate 70. The first board 80 is a well-known printed board on which electronic components and other similar components are mountable. The first board 80 is provided by a thin plate that is longer in the frontward and rearward directions 8 or in the rightward and leftward directions 9 than in the upward and downward directions 7. A controller, not shown, is for controlling operations of the MFD 10 and comprised of a microcomputer and various electronic components mounted on the first board 80.

There will be next explained one example of the control of the operations of the MFD 10 by the controller. The operations of the MFD 10 include: the supply of the recording sheet 15 by the sheet-supply roller 25; the conveyance of the recording sheet 15 by the conveyance roller pair 63 and the discharge roller pair 66; and the movement of the carriage 38 in the rightward and leftward directions 9. In the case of these operations, the controller controls the MFD 10 in the following manner. That is, the controller drives a sheet-supply motor, not shown, for rotating the sheet-supply roller 25 to rotate the sheet-supply roller 25. Further, the controller drives the above-described conveyance motor to rotate the conveyance roller 61 and the discharging roller 64 of the respective roller pairs 63, 66. Further, the controller drives the above-described carriage motor to move the carriage 38.

As shown in FIGS. 4, 7A, and 8A, the first board 80 is disposed on a left side of the cutout 71 formed in the plate 70 in the rightward and leftward directions 9. The first board 80 is disposed so as to expand from a front end portion of the plate 70 to a rear end portion thereof in the frontward and rearward directions 8.

<Film 96>

Figure 7B:
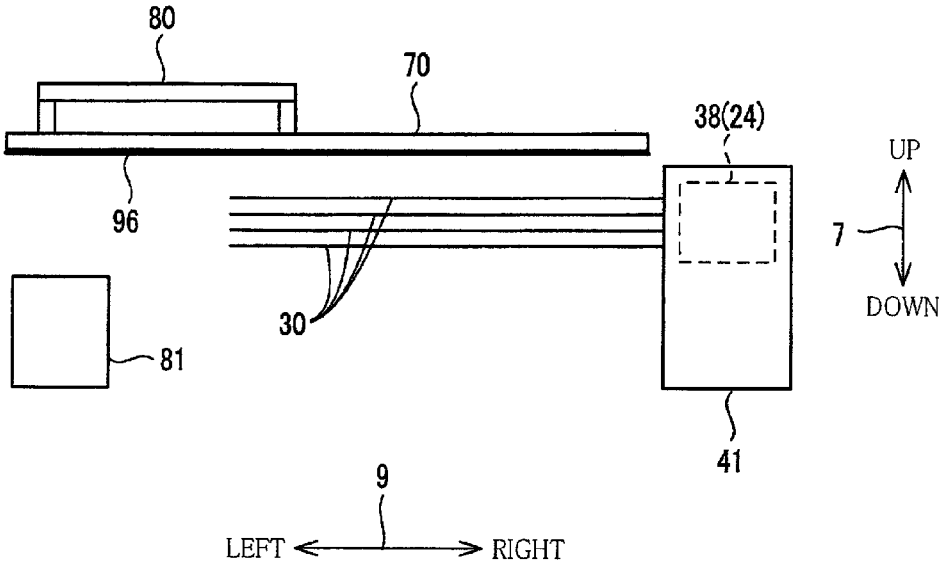

As shown in FIGS. 7B and 8B, a thin film 96 formed of polyethylene, polyvinyl chloride, and/or other similar material is bonded to one of opposite faces of the plate 70 which is nearer to the ink supply tubes 30 than the other (that is, the film 96 is bonded to a lower face of the plate 70 in the present embodiment). A surface of the film 96 preferably has a low friction. In general, a surface friction of the film 96 is lower where the film 96 is formed of the polyethylene or polyvinyl chloride than where the film 96 is formed of a metal such as iron and stainless steel.

<Second Board 81>

As shown in FIGS. 3 and 4, the second board 81 is disposed in the front left end portion of the printing section 11. It is noted that the second board 81 is constituted by (i) a board body, not shown in FIGS. 3 and 4, provided by a well-known printed board and (ii) a cover 82 for covering the board body. Like the first board 80, electronic components and the like are mounted on the board body. Specifically, on the board body are mounted electronic components, not shown, such as a condenser required for supplying an electric power to the electric components mounted on the MFD 10 such as the controller mounted on the first board 80. The electronic components mounted on the board body are connected to the electronic components mounted on the first board 80 and the electric components described above. As a result, the electronic components mounted on the board body can supply the electric power to the electronic components mounted on the first board 80 and the electric components described above. In view of the above, the electronic components mounted on the board body of the second board 81 are one example of the electric-power supply portion.

<Positions of Recording Portion 24, Ink Supply Tubes 30, First Board 80, and Second Board 81>

As shown in FIGS. 3, 4, 7B, and 8B, the first board 80 is disposed over the plate 70. Further, as shown in FIGS. 7B and 8B, the plate 70 is disposed over the ink supply tubes 30. That is, the first board 80 is disposed over the ink supply tubes 30. Specifically, the first board 80 overlaps the ink supply tubes 30 in plan view even when the shape of the ink supply tubes 30 in plan view is any shape (noted that the first board 80 may be disposed so as not to overlap the ink supply tubes 30 in plan view when the shape of the ink supply tubes 30 in plan view is a particular shape). As described above, the plate 70 is disposed so as to cover the occupied area 76 of the ink supply tubes 30 (see FIGS. 3, 7A, 8A, and 9).

In view of this configuration, as shown in FIGS. 7B, 8B, and 9, the first board 80 is disposed just over or right above the occupied area 76 of the ink supply tubes 30. In the present embodiment, a front left corner portion of the first board 80 is located outside the occupied area 76 of the ink supply tubes 30 in plan view, and the other portion of the first board 80 is located over the occupied area 76 of the ink supply tubes 30 in plan view. However, an entire face of the first board 80 may be located over the occupied area 76 of the ink supply tubes 30 in plan view. That is, at least a part of the first board 80 is disposed over the occupied area 76 of the ink supply tubes 30.

As shown in FIG. 3, a left end of the plate 70 is located at a left end portion of the printing section 11, while a right end of the plate 70 is located so as to be spaced apart from a right end of the printing section 11 with a predetermined distance.

As a result, as shown in FIGS. 3 and 7A, 7B, when the carriage 38 is located at a second position located at the right end portion of the printing section 11, the recording portion 24 does not overlap the plate 70 and the first board 80 supported by the plate 70 in plan view. That is, the recording portion 24 is exposed to an upper side thereof.

When the carriage 38 has been moved leftward to a first position on a left side of the second position, that is, as shown in FIG. 8, when the carriage 38 is located at the first position located at the left end portion of the printing section 11, for example, a portion (front portion) of the recording portion 24 is located in plan view under the plate 70 and the first board 80 supported by the plate 70. That is, the portion of the recording portion 24 is covered with the plate 70 and the first board 80 located above the recording portion 24.

It is noted that, in the present embodiment, the portion of the recording portion 24 located at the first position is covered in plan view with the plate 70 and the first board 80, but an entirety of the recording portion 24 located at the first position may be covered in plan view with the plate 70 and the first board 80. In view of this configuration, at least a portion of the recording portion 24 is located under the first board 80 in plan view in the state in which the recording portion 24 is located at the first position, and the recording portion 24 does not overlap the first board 80 in plan view in the state in which the recording portion 24 is located at the second position.

As shown in FIGS. 8A and 8B, a portion of the second board 81 is located in plan view under (within) the occupied area 76 of the ink supply tubes 30. In the present embodiment, a rear portion of the second board 81 is located in plan view under (within) the occupied area 76 of the ink supply tubes 30. It is noted that, in the present embodiment, a portion of the second board 81 is located in plan view under the occupied area 76, but an entirety of the second board 81 may be located in plan view under the occupied area 76.

In view of this configuration, at least a portion of the second board 81 is located in plan view under the occupied area 76. That is, in the present embodiment, as shown in FIGS. 7B and 8B, the ink supply tubes 30 are disposed between the first board 80 and the second board 81 in the upward and downward directions 7.

<Effects of Embodiment>

In the above-described embodiment, an area occupied by the first board 80 and the occupied area 76 allowed to be occupied by the ink supply tubes 30 whose shape is changeable can be partially shared with each other in plan view. This makes it possible to suppress an increase in a footprint of the MFD 10. That is, it is possible to reduce the footprint of the MFD 10. Further, the first board 80 is provided by the thin plate having a length in the frontward and rearward directions 8 or in the rightward and leftward directions 9 that is greater than that in the upward and downward directions 7. Thus, it is possible to suppress an increase in a length of the MED 10 in the upward and downward directions 7 and the increase in the footprint of the MFD 10.

In the above-described embodiment, the first board 80 is over the ink supply tubes 30. Thus, if the ink supply tubes 30 are damaged, it is possible to decrease a possibility that the ink having leaked from the ink supply tubes 30 contacts and adheres to the first board 80.

In the above-described embodiment, when the recording portion 24 is located at the first position, at least a part of the recording portion 24 is located within or under the first board 80 in plan view. Thus, an area occupied by the recording portion 24 and the area occupied by the first board 80 can be shared in plan view with each other.

In the above-described embodiment, when the recording portion 24 is located at the second position, the recording portion 24 can be demounted from the MFD 10 without removing the first board 80 from the MFD 10.

In the above-described embodiment, the plate 70 is disposed between the first board 80 and the ink supply tubes 30. Thus, if the ink supply tubes 30 are damaged, the ink having leaked from the ink supply tubes 30 contacts and adheres to the plate 70. As a result, it is possible to decrease the possibility that the ink having leaked from the ink supply tubes 30 contacts and adheres to the first board 80.

In the above-described embodiment, the plate 70 is formed of a metal, enabling a reduction in noise generated in the first board 80.

In the above-described embodiment, the protruding portions 73, 74, 75 are provided outside the occupied area 76 of the ink supply tubes 30 in plan view. As a result, it is possible to decrease a possibility that the ink supply tubes 30 moved following the movement of the recording portion 24 are brought into contact with the protruding portions 73, 74, 75.

In the above-described embodiment, the protruding portions 73, 74, 75 support the plate 70 at their respective three positions. This enables stable support of the plate 70.

In the above-described embodiment, the ink supply tubes 30 moved following the movement of the recording portion 24 are brought into contact not with the plate 70 but with the film 96 bonded to the plate 70. Here, the surface of the film 96 has a lower friction than that of the face of the metal plate 70, and thus the surface of the film 96 is more slippery. Thus, even if the ink supply tubes 30 are brought into contact with the film 96, the movement of the ink supply tubes 30 is less hindered by a friction between the ink supply tubes 30 and the film 96.

The second board 81 for supplying the electric power tends to heat up. However, in the above-described embodiment, the movement of the ink supply tubes 30 following the movement of the recording portion 24 generates an air flow in a space of the MFD 10. Thus, it is possible to suppress an increase in a temperature of the second board 81 due to the heating thereof.

In the above-described embodiment, the ink supply tubes 30 are disposed between the first board 80 and the second board 81 which generate heat. As a result, it is possible to disperse the heat generated by the first board 80 and the second board 81.

In the above-described embodiment, the MFD 10 includes the four ink supply tubes 30 corresponding to the inks of respective colors, but the MFD 10 does not need to include a plurality of tubes as the ink supply tubes 30. For example, the MFD 10 may include a single ink supply tube corresponding to the black ink.

In the above-described embodiment, when the recording portion 24 is located at the second position, the recording portion 24 does not overlap the plate 70 and the first board 80 in plan view. However, when the recording portion 24 is located at the second position, the recording portion 24 overlaps at least one of the plate 70 and the first board 80 in plan view.

In the above-described embodiment, the first board 80 is supported by the frame 72 via the plate 70, but the first board 80 may be directly supported by the frame 72 not via the plate 70, for example.

In the above-described embodiment, the protruding portions 73, 74 are provided outside the second portion 32 of the ink supply tube 30 in plan view, and the protruding portion 75 is provided inside the second portion of the ink supply tube 30 in plan view. However, the protruding portions 73, 74, 75 may be provided outside the second portion 32 in plan view, or the protruding portions 73, 74, 75 may be provided inside the second portion 32 in plan view, for example.

In the above-described embodiment, the film 96 is bonded to the one of opposite faces of the plate 70 which is nearer to the ink supply tubes 30 than the other, but the film 96 may be omitted.

In the above-described embodiment, a part of the second board 81 is disposed under (within) the occupied area 76 of the ink supply tube 30 in plan view, but an entirety of the second board 81 may be disposed under the occupied area 76 of the ink supply tube 30 in plan view.

In the above-described embodiment, the four ink supply tubes 30 are arranged in the upward and downward directions 7 in the area at which the occupied area 76 and the second board 81 are superposed on each other in plan view. However, the four ink supply tubes 30 do not need to be arranged in the upward and downward directions 7 in the area.

<First Modification>

Figure 10A:
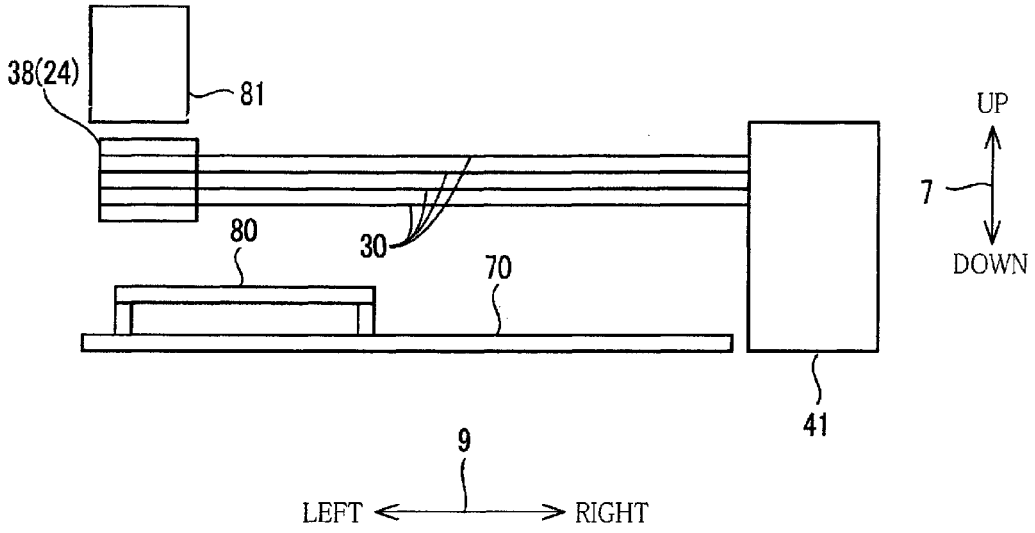
FIGS. 10A and 10B are front elevational views each schematically showing the positional relationship among the recording portion 24, the ink supply tubes 30, the cartridge mount 41, the plate 70, the first board 80, and the second board 81 in a first modification.

In the above-described embodiment, as shown in FIGS. 7B and 8B, the plate 70 and the first board 80 are disposed over the ink supply tubes 30, but as shown in FIG. 10A, the plate 70 and the first board 80 may be disposed under the ink supply tubes 30.

In the above-described embodiment, as shown in FIGS. 7B and 8B, the second board 81 is disposed under the ink supply tubes 30, but as shown in FIG. 10A, the second board 81 may be disposed over the ink supply tubes 30.

Figure 10B:
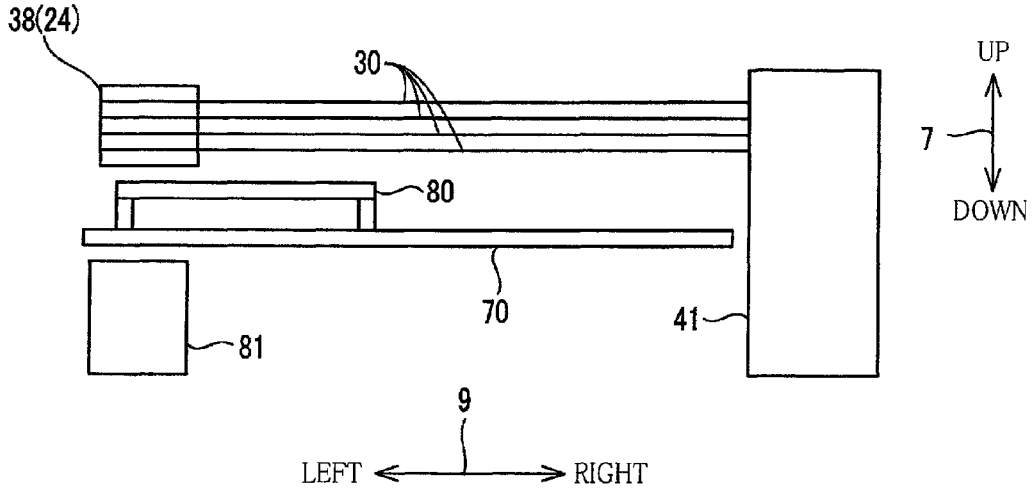

Further, as shown in FIG. 10B, both of the first board 80 and the second board 81 may be disposed under the ink supply tubes 30, for example.

In the above-described embodiment and the first modification, at least a part of the first board 80 and the second board 81 is disposed at a position overlapping the occupied area 76 of the ink supply tubes 30 in plan view.

In the first modification, the area occupied by the first board 80 and the area occupied by the ink supply tubes 30 in plan view can be partially shared in the frontward and rearward directions 8 and in the rightward and leftward directions 9. Further, the area occupied by the second board 81 and the area occupied by the ink supply tubes 30 in plan view can be partially shared in the frontward and rearward directions 8 and in the rightward and leftward directions 9

What is claimed is:

1. An ink jet recording apparatus, comprising:

a recording portion movable in directions along an image recording face of a recording medium and configured to eject droplets of ink to record an image on the recording medium;

at least one flexible ink supply tube connected to the recording portion for supplying the ink to the recording portion therethrough; and an ink-supply portion configured to supply the ink to the at least one flexible ink supply tube, wherein the at least one flexible ink supply tube includes:

a first end portion connected to the recording portion; and a second end portion connected to the ink-supply portion, wherein the at least one flexible ink supply tube extends at the first end portion in a first direction and is curved so as to extend to the ink-supply portion in a second direction that is different from the first direction, and a shape of the at least one flexible ink supply tube is changed following the movement of the recording portion, wherein the ink jet recording apparatus further comprises a frame and a first circuit board at least a portion of which is disposed at a position overlapping, in plan view, a first movable area that is an area within which the at least one flexible ink supply tube is movable while changing in shape, the first circuit board comprising electronic components mounted thereon, an uppermost position of the first movable area being defined by an upper edge of the at least one flexible ink supply tube while changing in shape, and the frame supporting the first circuit board in a manner such that the first circuit board is stationary with respect to the frame, wherein the uppermost position of the first movable area is lower in height than the first circuit board, wherein the recording portion is movable in a second movable area, wherein at least a portion of the recording portion overlaps the first circuit board in plan view in a state in which the recording portion is located at a first position on the second movable area, and wherein the at least a portion of the recording portion does not overlap the first circuit board in plan view in a state in which the recording portion is located at a second position on the second movable area which is different from the first position.

2. The ink-jet recording apparatus according to claim 1, wherein the at least a portion of the first circuit board, which is disposed at the position overlapping the first movable area, is located over the first movable area.

3. The ink-jet recording apparatus according to claim 1, further comprising a metal plate provided between the first circuit board and the at least one flexible ink supply tube in upward and downward directions, the first board being mounted on the metal plate, the frame supporting the metal plate in a manner such that the metal plate is stationary with respect to the frame.

4. The ink-jet recording apparatus according to claim 3, further comprising a support portion configured to support one of opposite faces of the plate, which one is nearer to the at least one flexible ink supply tube than the other of the opposite faces, the frame supporting the support in a manner such that the support is stationary with respect to the frame, wherein the support portion is provided outside the first movable area in plan view.

5. The ink jet recording apparatus according to claim 4, wherein the support portion is configured to support the plate at three positions including:

two positions outside a curved portion of the at least one flexible ink supply tube in plan view; and one position inside the curved portion of the at least one flexible ink supply tube in plan view.

6. The ink-jet recording apparatus according to claim 3, further comprising a film bonded on one of opposite faces of the plate, which one is nearer to the at least one flexible ink supply tube than the other of the opposite faces.

7. The ink-jet recording apparatus according to claim 1, further comprising a second circuit board including an electric-power supply portion configured to supply an electric power to the electric components on the first circuit board, the frame supporting the second circuit board in a manner such that the second circuit board is stationary with respect to the frame, wherein at least a portion of the second circuit board is disposed at a position overlapping the first movable area in plan view, wherein the at least one flexible ink supply tube is a plurality of ink supply tubes, and wherein the plurality of ink supply tubes are arranged in upward and downward directions in an area of the first movable area which overlaps the second circuit board in plan view.

8. The ink-jet recording apparatus according to claim 7, wherein the at least one ink supply tube is disposed between the first circuit board and the second circuit board in the upward and downward directions.

9. An ink jet recording apparatus, comprising:

a recording portion movable along one direction;

an ink-supply portion configured to supply ink to the recording portion;

at least one flexible ink supply tube connected between the recording portion and the ink-supply portion, wherein a shape of the at least one ink supply tube is changed following the movement of the recording portion;

a frame; and a circuit board configured to control the ink-jet recording apparatus, the frame supporting the circuit board in a manner such that the circuit board is stationary with respect to the frame, wherein a vertical projection of at least a portion of the circuit board is contained within a vertical projection of a first movable area, which is an area within which the at least one ink supply tube is movable while changing in shape, and an uppermost position of the first movable area being defined by an upper edge of the at least one flexible ink supply tube while changing in shape, wherein the uppermost position of the first movable area is lower in height than the circuit board, wherein the recording portion is movable in a second movable area, wherein at least a portion of the recording portion overlaps the circuit board in plan view in a state in which the recording portion is located at a first position on the second movable area, and wherein the at least a portion of the recording portion does not overlap the circuit board in plan view in a state in which the recording portion is located at a second position on the second movable area which is different from the first position.

10. An ink-jet recording apparatus, comprising:

a recording portion movable between a first position and a second position along one direction;

an ink-supply portion configured to supply ink to the recording portion;

at least one flexible ink supply tube connected between the recording portion and the ink-supply portion;

a frame; and a circuit board configured to control the ink jet recording apparatus, the frame supporting the circuit board in a manner such that the circuit board is stationary with respect to the frame, wherein a vertical projection of at least a portion of the at least one ink supply tube is contained within a vertical projection of the circuit board when the recording portion is placed at at least one of the first position and the second position, wherein an upper edge of the at least one flexible ink supply tube is lower in height than the circuit board when the recording portion is placed at any of the first position and the second position, wherein the recording portion is movable in a movable area, wherein at least a portion of the recording portion overlaps the circuit board in plan view in a state in which the recording portion is located at a particular position on the movable area, and wherein the at least a portion of the recording portion does not overlap the circuit board in plan view in a state in which the recording portion is located at another position on the movable area which is different from the particular position.

11. An ink jet recording apparatus, comprising:

a casing;

a recording portion provided in the casing and movable between a first position and a second position along a first direction;

an ink-supply portion provided in the casing and configured to supply ink to the recording portion;

at least one flexible ink supply tube connected between the recording portion and the ink-supply portion;

a frame; and a circuit board provided in the casing and configured to control the ink jet recording apparatus, the frame supporting the circuit board in a manner such that the circuit board is stationary with respect to the frame, wherein a distance, along a second direction perpendicular to the first direction and parallel to a surface of the circuit board, between a front face of the casing and at least a portion of the ink supply tube is equal to a distance along the second direction between the front face of the casing and at least a portion of the circuit board, and wherein an upper edge of the at least one flexible ink supply tube is lower in height than the circuit board when the recording portion is placed at any of the first position and the second position, wherein the recording portion is movable in a movable area, wherein at least a portion of the recording portion overlaps the circuit board in plan view in a state in which the recording portion is located at a particular position on the movable area, and wherein the at least a portion of the recording portion does not overlap the circuit board in plan view in a state in which the recording portion is located at another position on the movable area which is different from the particular position.

* * * * *